United States Patent [19]

Odlin

[11] Patent Number: 4,607,798

[45] Date of Patent: Aug. 26, 1986

[54] LAMP CRUSHING MACHINE

[76] Inventor: Kenneth F. Odlin, Wynfleet, Skegness Road, Hogsthorpe, Lincolnshire, England

[21] Appl. No.: 593,689

[22] Filed: Mar. 26, 1984

Related U.S. Application Data

[63] Continuation-in-part of Ser. No. 312,841, Oct. 19, 1981, abandoned.

[30] Foreign Application Priority Data

Oct. 29, 1980 [GB] United Kingdom ..... 8034719

[51] Int. Cl.[4] ..... B02C 19/14

[52] U.S. Cl. ..... 241/99; 241/243; 241/293

[58] Field of Search ..... 241/99, 190, 243, 277, 241/293, 294, 57

[56] References Cited

U.S. PATENT DOCUMENTS

| | | | |
|---|---|---|---|
| 2,584,262 | 2/1952 | Lamater, Sr. | 241/190 |
| 3,913,849 | 10/1975 | Atanasoff et al. | 241/99 X |
| 4,327,870 | 5/1982 | Haikkala | 241/57 X |

*Primary Examiner*—Howard N. Goldberg
*Assistant Examiner*—Timothy V. Eley
*Attorney, Agent, or Firm*—Ross, Ross & Flavin

[57] ABSTRACT

A lamp crushing machine comprises a casing which may be divided into upper, central and lower zones. Lamps which are to be disposed of are loaded into the upper zone. In the central zone there is a horizontally mounted drum with a number of radial vanes and possibly also circumferential vanes. When this drum is rotated the lamps are progressively broken by the shearing action of the vanes as they pass close by the edges of walls which project inwardly from the casing. Unbreakable parts such as lamp and caps are carried around the drum in pockets arranged between the vanes. The debris falls into a hopper in the lower zone which can be removed and emptied periodically. Throughout operation of the machine the lamps are doused by water issuing from a nozzle to quench any igniting sodium. Dangerous vapors pass out through special vents and other contaminents are filtered out of the water draining from the machine. The drum can be rotated manually by means of a handle but is preferably rotated rapidly by an electrical motor.

3 Claims, 8 Drawing Figures

LAMP CRUSHING MACHINE

RELATED APPLICATIONS

This application is a continuation-in-part of application Ser. No. 312,841 filed Oct. 19, 1981 now abandoned.

TECHNICAL FIELD

The invention relates to a machine for breaking lamps, the term lamp being taken to mean all types of lamps including sodium and mercury vapour lamps and fluorescent tubes.

BACKGROUND OF THE INVENTION

Disused lamps are most conveniently disposed of by crushing into pieces of a size small enough for industrial or commercial refuse collection. Manual disposal inevitably means smashing lamps with an iron bar or throwing bricks at them such that razor sharp glass splinters tend to fly in every direction and a worker's eyes are particularly vulnerable if not protected. Moreover with some lamps there is a serious danger of injury from fire or hazardous chemicals.

Sodium vapour lamps contain metallic sodium which, when released burns fiercely in contact with water—even moisture in the air. Indeed, when a skip full of such lamps is manually smashed and doused the sodium/water reaction is very fierce and the flames may harm an unwary worker. Also the old manual method of smashing lamps in a skip and then hosing can leave some lamps unbroken or just cracked. These could break at any time and start a fire in the skip, refuse truck or rubbish heap. Moreover, in metallic sodium and the caustic soda which is formed when it reacts with water will both burn skin and eyes, on contact therewith, so careless disposal can lead to injury. Furthermore, since hydrogen gas, which creates an explosive atmosphere when mixed with air at 4% concentration, is formed when sodium reacts with water, haphazard manual disposal in inadequately ventilated skips or refuse containers could lead to a dangerous build up of this explosive gas.

Mercury vapour lamps, of course, contain mercury which is a poison since it vaporises at room temperature and is thus absorbed into the body. It must be disposed of carefully and not allowed to escape to water systems and pollute the environment. Fluorescent tubes contain small amounts of other poisons such as strontium, cadmium and lead which may be breathed in during manual lamp disposal.

Manual disposal also tends to mean that large quantities of used lamps are stacked up in odd heaps in depots or vehicles for days or weeks before disposal. Because they must be stored in dry areas, this wastes space. The risk of fire in the storage area is also a problem where sodium lamps are concerned. If just one sodium vapour lamp is cracked the sodium may react with moisture in the air and cause a serious fire, and/or give rise to the other dangers mentioned above. Similarly there is a risk of pollution where disused mercury lamps or fluorescent lamps are stored for long periods of time.

To obviate the above-discussed health and fire risks it is necessary to crush disused lamps in a closed, suitably vented container and spray water onto the contents to quench any sodium/water reaction.

PRIOR ART

A machine for crushing lamps such as fluorescent tubes and mercury and sodium lamps is described in U.S. Pat. No. 3,913,849 (Atanasoff et.al). This machine is provided with a small rotatable blade mounted on a vertical spindle in the path of the lamps. It would accordingly be ineffective in breaking small lamps which would be likely to fall straight past the blade. The applicant is also aware of another previously proposed machine on the market in the U.K. In this machine, the lamps are placed lengthwise between two pistons, at least one of which is then moved towards the other so that the lamps are broken by pressure at each end. This machine is also ineffective as the glass of the lamps is not necessarily broken into small disposable pieces, the breaking operation takes a relatively long time, and different distances between the pistons are required for different types of lamp.

OBJECT OF THE INVENTION

The object of the present invention is to provide an improved lamp crushing machine which quickly and efficiently breaks all types of disused lamps into small pieces for disposal. The machine must effectively crush all the lamps fed into it irrespective of their size and without requiring adjustment for lamps of different size. Moreover, the breaking mechanism of the machine must be such that it will not be susceptible to jamming or damage from the metal parts which form a significant part of many lamps. The machine must also of course provide for removal and safe disposal of hazardous vapours, such as mercury, sodium and phosphorus, released from the broken lamps.

BRIEF SUMMARY OF THE INVENTION

With the foregoing objects in view, the present invention provides a lamp crushing machine comprising a casing divided into three zones, namely an upper zone, a central zone and a lower zone, an entrance being provided in said upper zone through which lamps may be loaded into said casing; a rotatable rotor mounted substantially horizontally and extending substantially the full width of said casing in said central zone and having radial vanes extending longitudinally thereof; a wall projecting inwardly of said casing in said central zone and having an edge in close proximity to said rotor; means for rotating said rotor so as to crush lamps placed in said upper zone between said vanes and said edge; and a hopper located in said lower zone, beneath said rotor, to receive end caps and crushed pieces of lamps as they fall from said rotor.

The drum may be rotated manually by means of a handle projecting through the casing or alternatively an electrical motor may be provided to drive the drum upon actuation of a switch to supply power to the motor.

BRIEF DESCRIPTION OF THE DRAWINGS

The invention will be described further, by way of example, with reference to the accompanying drawings, in which.

DETAILED DESCRIPTION OF THE ILLUSTRATED EMBODIMENTS

Figure 1:
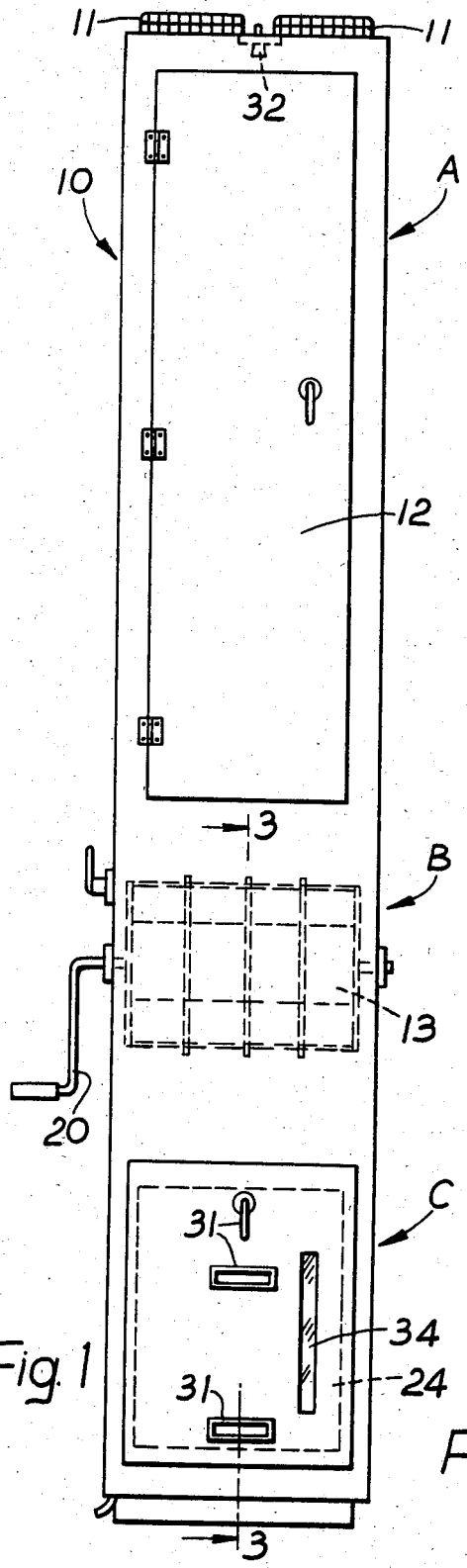
FIG. 1 is a front view of a first practical embodiment of the lamp crushing machine of the invention.
Figure 2:
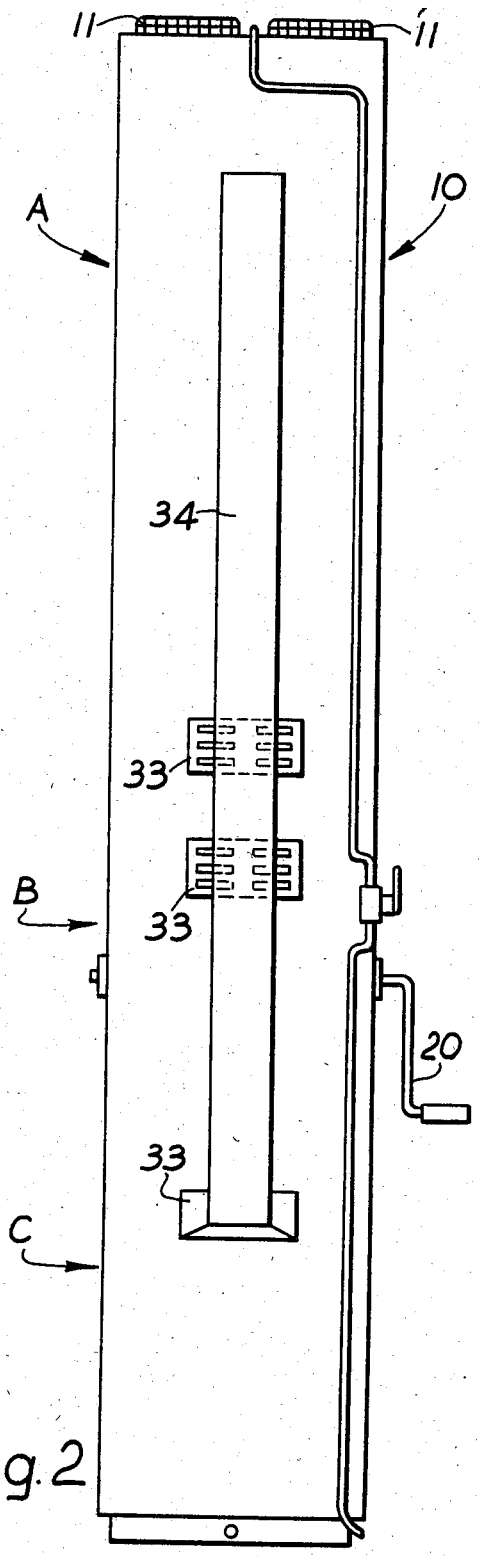
FIG. 2 is a rear view of the same machine.
Figure 3:
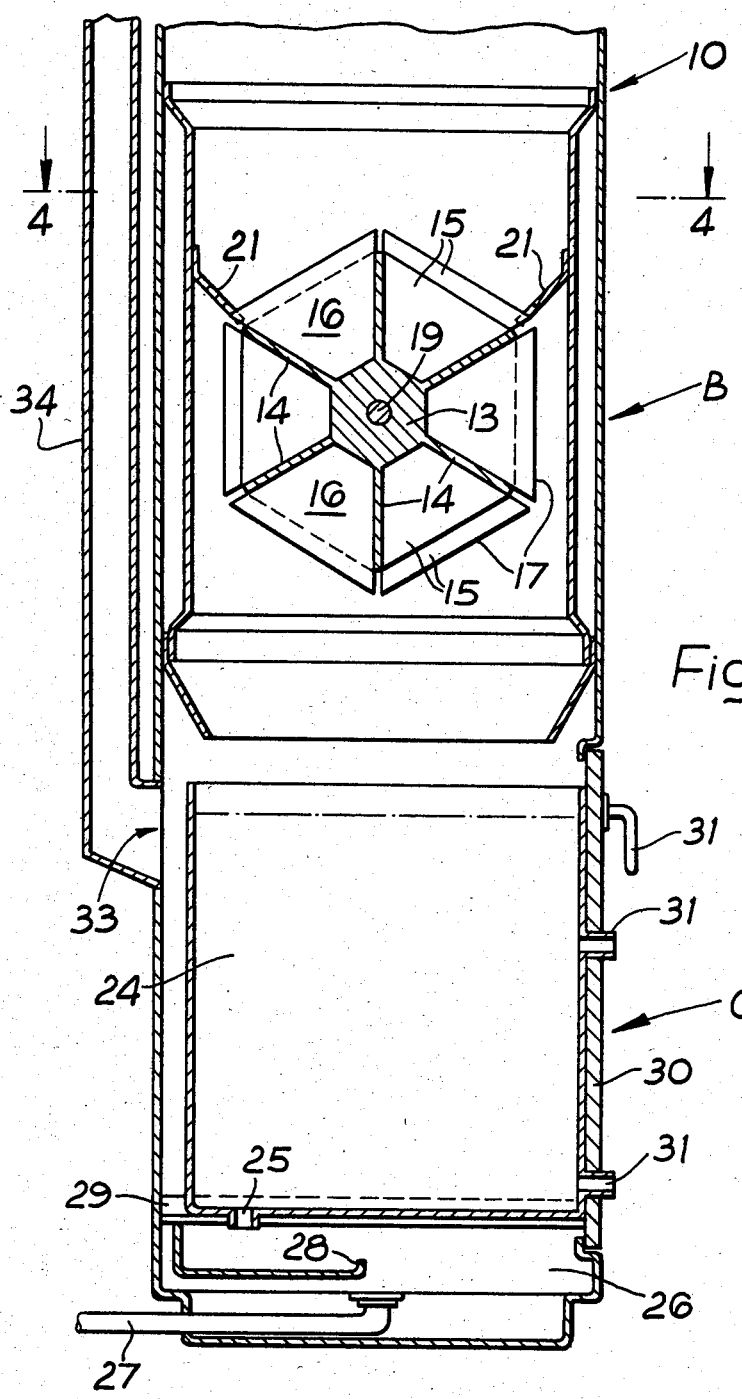
FIG. 3 is an enlarged cross-section of the central and lower zones of the machine shown in FIGS. 1 and 2, along the line 3—3 of FIG. 2.
Figure 4:
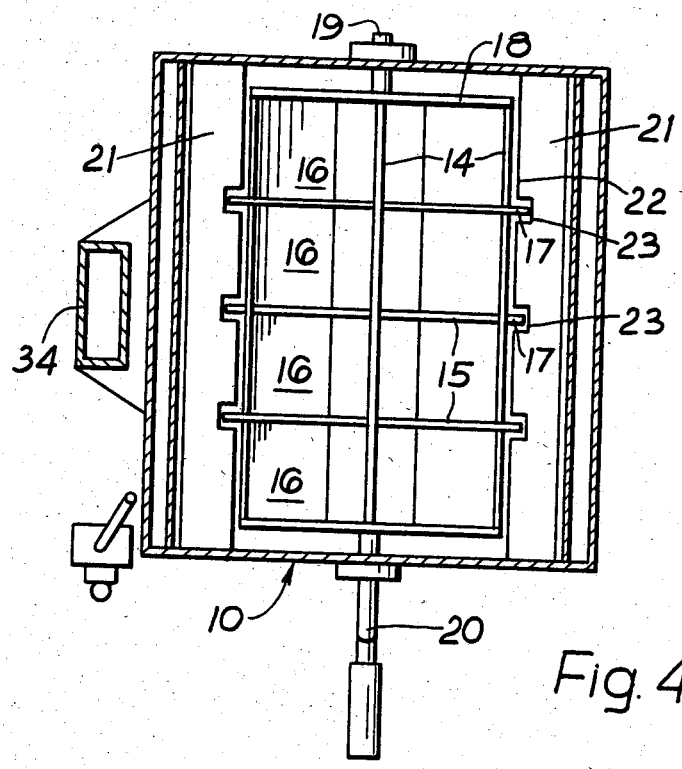
FIG. 4 is a transverse cross-section through the same machine along the line 4—4 of FIG. 3.
Figure 5:
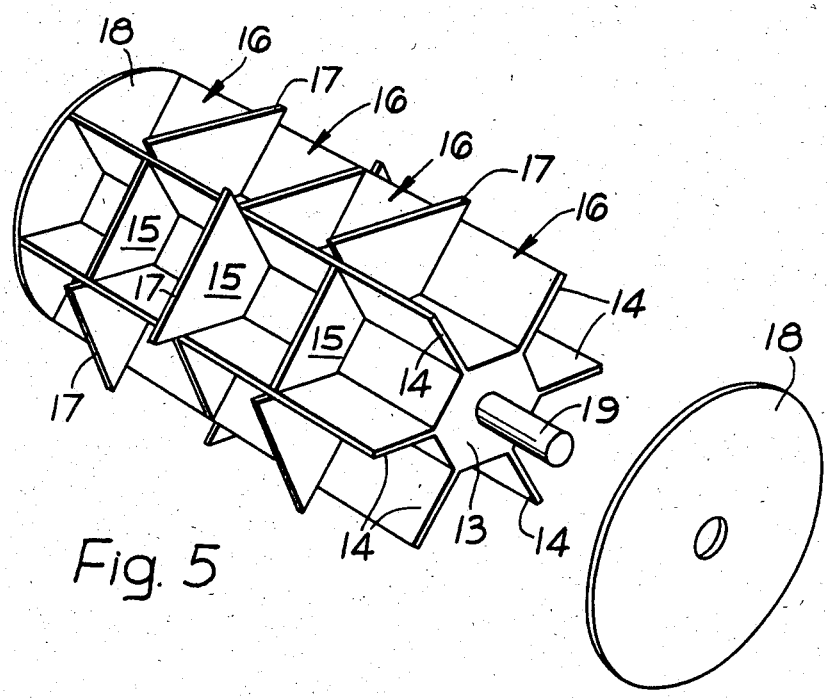
FIG. 5 is an exploded perspective view of the rotor of the machine shown in FIGS. 1 to 4.

FIGS. 1 and 2 illustrate a first manually actuatable embodiment of the lamp crushing machine of the invention and FIGS. 3 to 5 show certain parts thereof in greater detail. This machine comprises an upright rectangular box-like casing 10 of sheet metal, e.g. stainless steel, which may be motionally divided into three zones, namely an upper zone A, a central zone B and a lower zone C.

The upper zone A of the machine casing may be from 5 feet to 8½ feet high and can thus accommodate all sizes of lamps including fluorescent tubes from 6 inches to 8 feet in length. A long rectangular door 12 is provided in one wall of the casing 10 and the top of the casing 10 is preferably formed as two hinged parts 11 to enable longer tubes to project and gradually lower as they are broken up.

The central zone B of the machine contains a substantially horizontally mounted rotor as shown in FIGS. 3 and 5, consisting of a drum of hexagonal cross section having radial vanes 14 approximately 7 inches high along each of the six face intersections. Between each pair of adjacent vanes 14 there extend three equally spaced circumferential or cross vanes 15. The surface of the drum 13 is thus provided with pockets 16 between the intersecting radial vanes 14 and cross vanes 15 of a suitable size for reception of lamp end caps. Alternately the two outer cross vanes 15 between one pair of radial vanes 14 and the central cross vane 15 between each vane 14 of that pair and the next adjacent radial vanes 14 extend outwards beyond the other vanes 14, 15 to form cutting edges 17. The drum 13 also has circular plates 18 at each end. These end plates 18 are mounted on respective ends of a spindle 19 and have a radius extending to the edge of the radial vanes 14.

The spindle 19 is journalled in the casing 10 so that the drum 13 as a whole is rotatable and a cranked handle 20 fits onto one end of the spindle 19 outside the casing 10.

A pair of downwardly inclined walls 21 project inwardly from opposite sides of the casing 10 adjacent the drum 13, as shown in FIGS. 3 and 4. These walls 21 provide respective cutting edges 22 each with three spaced apart notches 22. The drum 13 extends substantially the full width of the casing 10, the axis of the drum being parallel with the longitudinal extent of the inclined walls 21. The vanes 14, 15 pass closely adjacent the edges 22 of the walls 21 as the drum 13 is rotated, with the cutting edges 17 of certain vanes 15 passing through the notches 23. Accordingly, lamps placed in the upper zone A cannot fall or slide past the drum without encountering the crushing mechanism provided by the co-operating cutting edges 17, 22.

The lower zone C of the machine, as best seen in FIG. 3, is approximately 2½ feet high and includes a skip or hopper 24 for reception of broken glass and metal. There is an outlet 25 in the bottom of the skip 24 communicating with a shallow compartment 26 below the skip 24 from which a drainage pipe 27 leads. A lip or weir 28 is provided in the compartment 26 for reasons explained later. There is also an overflow outlet (not shown) close to the top of the skip 24 and a sight gauge 35 (FIG. 1) through which the level of water in the skip 24 can be observed. The skip 24 is mounted on rails 29 and at one side it is fastened to an openable panel 30 in the casing 10 such that the skip can be removed from the casing by unlocking said panel 30 and pulling same out by means of handles 31. The skip 24 may also have a liner (not shown) which can be easily lifted out when the skip is pulled out of the casing.

Finally a spray nozzle 32 connected to a main water supply inlet is saturated at the top of the upper zone A and vents 33 are provided in each zone A,B,C communicating with a vent pipe 34 extending up the rear of the casing 10.

In use, lamps of any size and any type are loaded through the door 12 into the upper zone A and the door 12 is securely fastened. (A positive door interlock system prevents operation of the machine when the door 12 is open). The main water supply is switched on so that a jet of water issues from the nozzle 32 and floods the upper zone A. An operator turns the external handle 20 of the rotatable drum 13 and the lamps which impinge on the drum 13 are broken between the vanes 14, 15 and the cutting edges 22 of the walls 21 as the drum rotates. As previously mentioned, no lamps can fall or slide past the drum 13 without being broken. If a small lamp, such as a 6 inch long sodium arc lamp, falls horizontally onto the edges of the drum vanes 14, 15 it cannot slide past the drum and it will probably be crushed between the cutting edges 17 and the notches 23. Hard unbreakable objects, such as the metal, end caps of the lamps lodge in the pockets 16 formed between vanes 14, 15 and end plates 18 on the drum 13. They are thus carried around as the drum 13 rotates and fall into the skip or hopper 24 without jamming the crushing mechanism. Broken pieces of glass are also carried around the drum 13 in the pockets 16.

The jet of water assists in carrying the debris through to the hopper 24 as well as serving to safely remove any mercury vapour and quench any igniting sodium released from the lamps. Water gradually accomulates in the skip or hopper 24 as it drains more slowly from the outlet 25 than the rate at which it enters from the nozzle 32. When the skip 24 is full of water, water issues from the overflow outlet and the main water supply should be switched off. As water passes slowly through the compartment 26 the weir 28 traps any mercury released from the broken lamps. The water may also be filtered before or after it leaves the compartment 26 to prevent any contaminants reaching the drain. The skip 24 is, of course, periodically removed and emptied of debris when the machine is not in operation.

It will be appreciated that all the risks of fire, injury and contamination which are present when manual breakage of lamps is undertaken are obviated by use of this machine, which quickly and efficiently breaks all types of lamps with minimum liklihood of jamming or breakdown of the crushing mechanism. In the latter respect, the pockets formed between the vanes to receive end caps and other debris are especially important.

The above-described manually operated machine may, of course, be modified in various ways without departing from the general scope of the invention. For example, the number and position of vanes may vary and the cross-vanes and end caps may be omitted completely. Moreover such a machine could be fitted with a motor or a compressed air supply to drive the drum.

Figure 6:
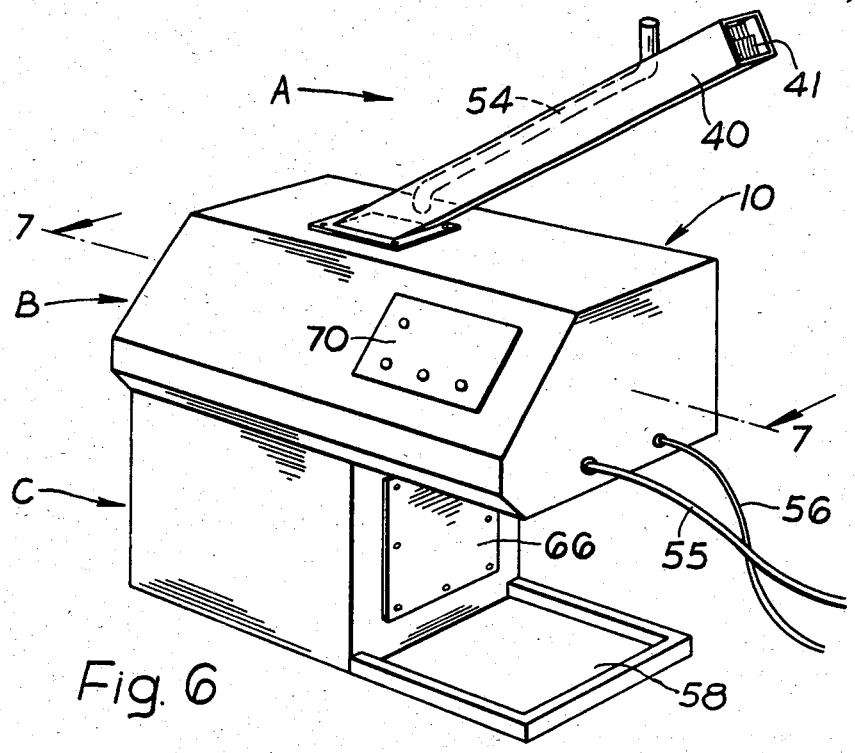
FIG. 6 is a perspective view of a second practical embodiment of the lamp crushing machine of the invention.
Figure 8:
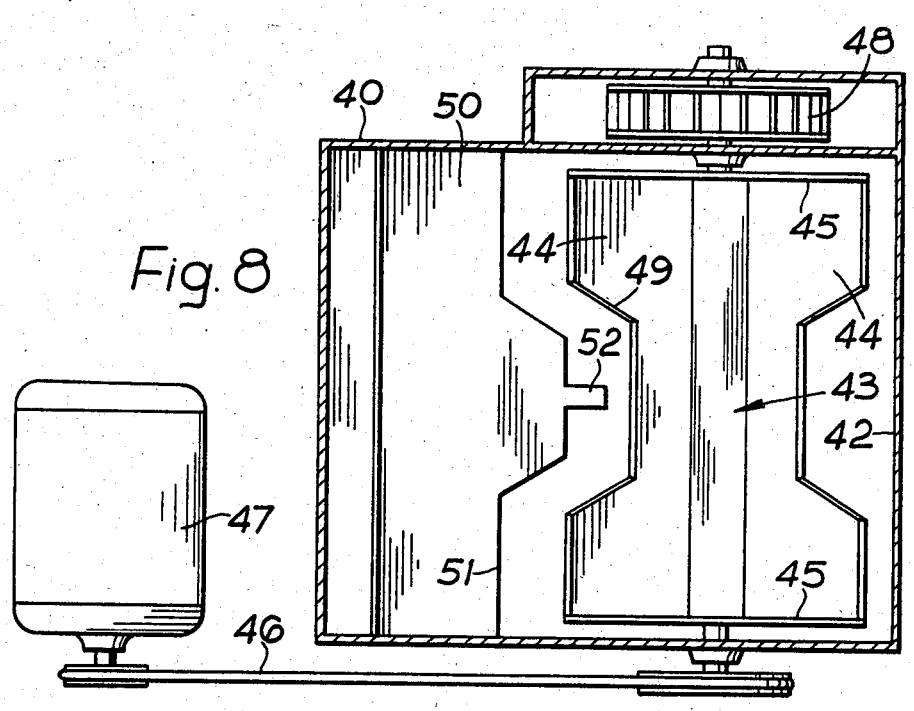
FIG. 8 is a partial transverse cross-section along the line 8—8 in FIG. 7 illustrating the rotor and shearing means of the second embodiment.
Figure 7:
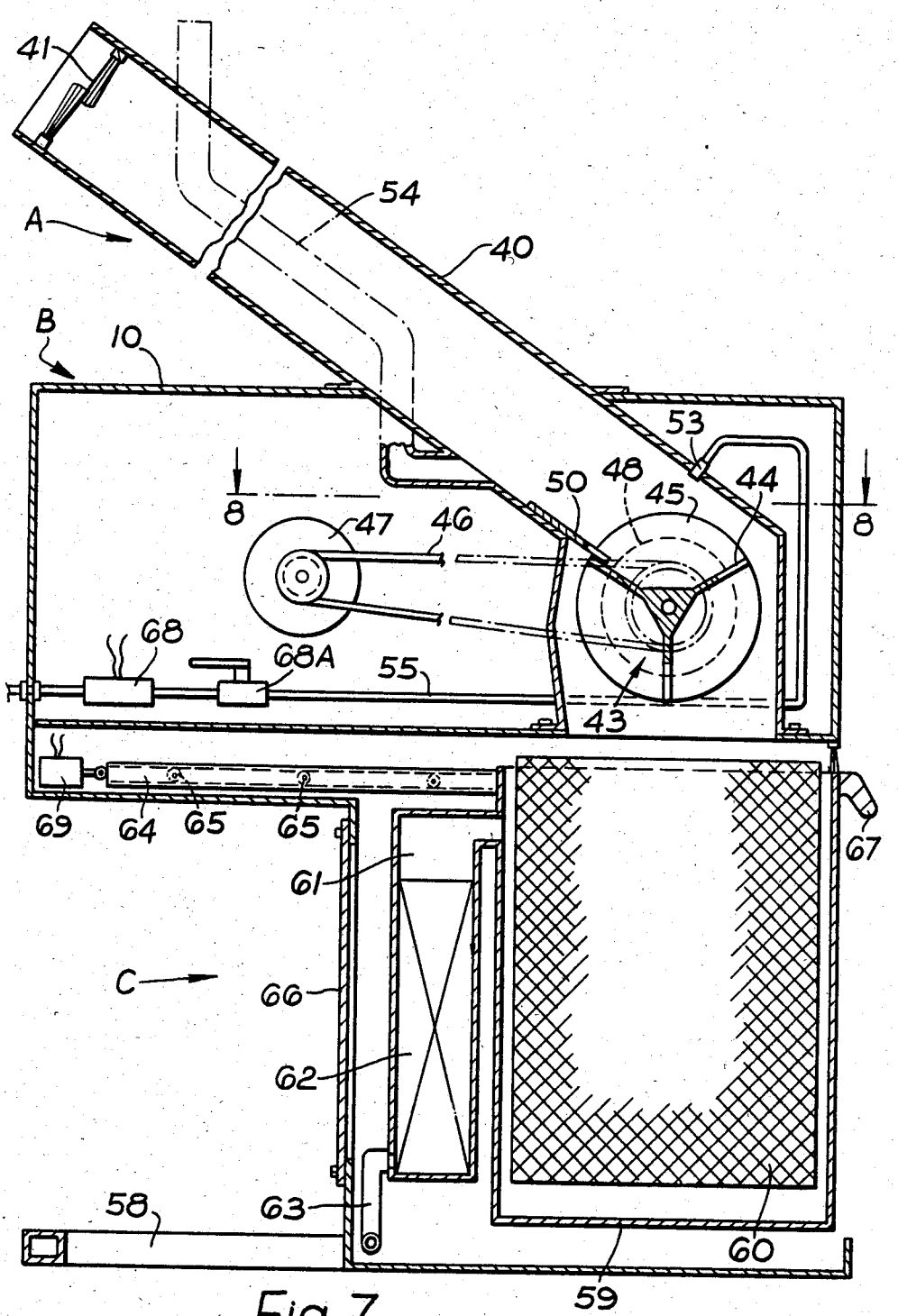
FIG. 7 is a longitudinal cross-section, to an enlarged scale, of the machine shown in FIG. 6 along the line 7—7 of FIG. 6.

FIGS. 6 and 7 illustrate a second, electrically operated embodiment of the lamp crushing machine of the invention and FIG. 8 shows the crushing mechanism in greater detail. This machine is now the preferred practical embodiment. This machine again comprises a casing 10 which, for ease of description can be divided into three zones, namely an upper zone A, a central zone B and a lower zone C.

In this case, the upper zone A is formed by an inclined stainless steel chute 40 approximately 5 feet in length and of square cross-section with an open upper end into which lamps of all types may be fed. For safety reasons, to prevent any broken pieces of glass or lumps of metal flying out of the chute 40, a brush seal 41 is provided adjacent its upper end. If required, for the support of long fluorescent tubes an additional section of chute may be fitted onto the upper end of the illustrated chute 40. It may be held in place by a friction fit or by means of lugs and notches etc.

The central and lower zones B,C of the casing may be formed of PVC coated mild steel or stainless steel or moulded plastics. The chute 40 extends downwards and merges into a rotor housing 42 disposed within the central zone B. A rotor 43 consisting of a drum of triangular cross-section having three equidistant radial vanes 44 and respective circumferential end plates 45 is mounted transversely of the housing 42 on a spindle. A drive belt 46 connects the rotor 43 to an electrical motor 47 and a fan 48, also driven by the motor 47 is mounted adjacent one end plate 45 of the rotor 43. Power is supplied to the motor 47 via an electrical cable 56.

As shown in FIG. 8, the three vanes 44 all have a relatively large central recess 49. A downwardly inclined plate 50 projects into the housing 42 from the lower side of the chute 40 and provides an edge 51 with a broad central projection having a central finger 52. The vanes 44 pass the edge 51 at a distance apart of about 1.25 inches when the drum 43 rotates and cooperate therewith and with the finger 52 to break any lamps loaded into the chute 40.

As shown in FIG. 7, a spray nozzle 53 is mounted in the wall of the housing 42 immediately above the rotor 43. This nozzle 53 is connected to a mains water supply via pipe 55. A vent pipe 54 also extends upwardly within the chute 41. An electrical control panel 70 is fitted on the outside of the central zone B of the casing 10.

The lower zone C of the casing 10 is somewhat narrower than the central zone B, as illustrated in FIGS. 6 and 7, but it includes a support platform 58 beneath the main overhanging portion of the central zone to give stability to the machine. The lower zone C encloses a hopper or skip 59 having a perforated liner 60 arranged directly beneath the rotor 43 for reception of debris from crushed lamps. Extending from the rear of the skip 59 is a compartment 61 containing a filter element 62. A drainage pipe 63 leads from the compartment 61 beneath the filter 62. The front of the skip 59 forms the front wall of the lower zone C and the skip 59 together with the filter 62 can easily be pulled out of the machine by means of a handle 67. The skip 59 has elongate runners 64 fitted along each side, near the mouth of the skip 59, which run on a series of rollers 65 mounted along each side wall of the casing 10. The runners 64 project rearwardly beyond the skip 59 and their distal ends actuate a safety switch 69 such that power can only be supplied to the motor 47 to drive the rotor 43 to crush lamps when the skip 59 is correctly in position in the lower zone C. At all other times the power is disconnected. A filter access plate 66 is screwed in place on the rear of the lower zone C so that the filter can be removed and replaced from time to time.

This machine is electrically operated and so avoids the hard work involved in using the previously described manually operated machine, which it must be added often leads to lamp storage with the inherent dangers mentioned in the introduction hereto.

The operating procedure is straightforward and almost anyone can be taught how to use the machine in a few minutes. Firstly the main water supply is connected and the skip 59 located in position in the lower zone C. Power can then be switched on and the motor 47 will drive the crushing rotor 43 and the fan 48. Water will simultaneously be supplied through the nozzle 53. The water supply is controlled by a solenoid actuated valve 68 and monitored by a water flow switch 68A. The valve 68 ensures that optimum water pressure is maintained and the switch 68A will prevent operation of the motor without adequate water supply. Conversely, water is only supplied to the nozzle 53 to give a jet directed onto the rotor when the motor 47 is running. As previously mentioned, it is impossible for an operator to gain access to the housing 42 while the motor 47 is operating because removal of the skip 59 causes the motor 47 to cut out.

Lamps of any size or type are simply fed into the chute 40 by hand and, due to gravity, they slide or fall downwards onto the rotating rotor 43. Within seconds any lamp is reduced to fragments about 1 inch in size by the co-operative shearing action of the vanes 44 and the plates 50, the fingers 52 preventing pieces of glass falling past the rotor until sufficiently reduced in size. Metal end caps and internal components lodge between the radial vanes 44 of the rotor 43 and thus pass through the housing 42 into the skip 59. There is no possibility of any type of lamp passing through unbroken.

The rotor 43 is constantly doused with water which reacts with released sodium metal and dangerous gases are dispersed up the vent pipe 54 by the action of the fan 48.

In the unlikely event of a rotor jam a thermal overload will cut out the motor and this will be indicated by a warning light on the control panel 70. After a short interval, the cut out will re-set automatically so the machine will operate when the obstruction is removed and the power switched on again.

Once the skip 59 is two thirds full of debris, the water supply and power should be switched off. The skip 59 can then be removed and the liner 60 containing the fragmented glass and metal parts lifted out and emptied into normal refuse containers or areas. The debris occupies only about 2% of the original volume of the lamps.

The machine just described provides the most efficient and hazard free method of lamp disposal heretofore proposed. All sizes of sodium and mercury, vapour lamps and fluorescent tubes are crushed into compact fragments. Dangerous sodium metal is neutralised and poisonous mercury filtered out. All of the personnel risks and fine hazard of manual disposal and storage are eliminated.

Both the above described machines can also be used to dispose of other types of glass waste and bottles. In an electrically operated machine the drum rotates so rapidly that it has been found that cross-vanes are not required and indeed are preferably not provided as they could lead to jamming of the mechanism.

I claim:

1. A lamp crushing machine comprising:

a casing dividable into a central zone and a lower zone, an inclined chute having an open upper end and an open lower end communicating with the central zone of the casing for receiving lamps introduced thereinto, a rotor housing disposed within the central zone of the casing, a rotor consisting of a drum of triangular cross-section having a trio of equidistant radial vanes and circumferential end plates at its opposite ends and being mounted transversely of and substantially the width of the rotor housing, electrical drive means for driving the rotor, each radial vane having a central outwardly-facing recess, a downwardly-inclined plate fixed to the inclined chute and projecting into the rotor housing and having a central outwardly-facing projection and a central finger extending from and outboard of the projection toward and complementing the recesses of the successive vanes rotatable therepast for the crushing of lamps fed between the plate and rotor, a hopper located in the lower zone of the casing beneath the drum for receiving crushed pieces of the lamps falling from the drum.

2. The lamp crushing machine of claim 1 including, vent means in the casing for facilitating the removal of any vapours emanating from the crushed lamps.

3. The lamp crushing machine of claim 1 including a spray means for providing a fluid spray for dousing any flammable substances released from the crushed lamps.

* * * * *